US007484686B2

(12) United States Patent
Seger et al.

(10) Patent No.: US 7,484,686 B2
(45) Date of Patent: Feb. 3, 2009

(54) PROCESS FOR WINDING A WEB SUBSTRATE

(75) Inventors: Geoffrey Eugene Seger, Tunkhannock, PA (US); William Keith Kennedy, Leesburg, GA (US); Michael Joseph Franz, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 235 days.

(21) Appl. No.: 11/491,414

(22) Filed: Jul. 21, 2006

(65) Prior Publication Data

US 2008/0017748 A1 Jan. 24, 2008

(51) Int. Cl.
*B65H 18/14* (2006.01)

(52) U.S. Cl. ..... 242/541.4; 242/534; 242/547

(58) Field of Classification Search ..... 242/541.4, 242/547, 534; 700/126
See application file for complete search history.

(56) References Cited

U.S. PATENT DOCUMENTS

| | | | | |
|---|---|---|---|---|
| 3,586,222 | A | 6/1971 | Rosen | |
| 3,600,747 | A | 8/1971 | McCarty | |
| 3,671,835 | A | 6/1972 | McMenamy et al. | |
| 3,978,784 | A | 9/1976 | Bryce et al. | |
| 3,991,349 | A | 11/1976 | Watson et al. | |
| 5,256,944 | A | 10/1993 | Tobise et al. | |
| 5,553,589 | A | 9/1996 | Middleton et al. | |
| 5,848,756 | A * | 12/1998 | Sollinger et al. | 242/412 |
| 6,677,736 | B1 | 1/2004 | Barnes et al. | |
| 6,712,938 | B1 | 3/2004 | Laepaekoski et al. | |
| 6,991,144 | B2 | 1/2006 | Franz et al. | |
| 6,993,964 | B2 | 2/2006 | Franz et al. | |
| 7,325,489 | B2 * | 2/2008 | Zeigler et al. | 100/35 |
| 2004/0045454 | A1 | 3/2004 | Maenpaa et al. | |
| 2007/0285045 | A1 * | 12/2007 | Franz | 318/799 |

FOREIGN PATENT DOCUMENTS

| | | |
|---|---|---|
| EP | 1634994 A1 | 6/2005 |
| WO | WO 2005/078189 | 8/2005 |

OTHER PUBLICATIONS

U.S. Appl. No. 11/451,805, filed Jun. 13, 2006, Zeigler.
U.S. Appl. No. 11/451,817, filed Jun. 13, 2006, Franz.

* cited by examiner

*Primary Examiner*—Sang Kim
(74) *Attorney, Agent, or Firm*—Peter D. Meyer

(57) ABSTRACT

A process for adjusting a property of a web substrate is disclosed. The steps include: (a) providing a nip load profile; (b) providing a calender load profile; (c) providing a desired first physical characteristic of the web substrate; (d) providing a desired second physical characteristic of the convolutely wound product; (e) winding the web substrate to form the convolutely wound product; (f) measuring an actual first physical characteristic of the web substrate; (g) comparing the actual first physical characteristic and the desired first physical characteristic; (h) adjusting the calender load profile according to the comparison of the actual first physical characteristic and the desired first physical characteristic; (i) measuring an actual second physical characteristic of the convolutely wound product; (j) comparing the actual second physical characteristic and the desired second physical characteristic; and, (k) adjusting the nip load profile according to said comparison of the actual second physical characteristic and the desired second physical characteristic.

20 Claims, 5 Drawing Sheets

PROCESS FOR WINDING A WEB SUBSTRATE

FIELD OF THE INVENTION

The present invention relates to a process for winding a web substrate. More particularly, the present invention relates to coordinating the processes of calendering and winding for converting a paper web into rolls of saleable product.

BACKGROUND OF THE INVENTION

In the process of converting web substrates into wound parent rolls using conventional calendering and reel nip loading processes, it is known to those in the winding arts that the internal radial pressure within the parent roll increases as the number of layers is increased. As such, it is known to those in the winding industry that each layer of a wound paper web can provide pressure to each succeeding layer convolutely disposed beneath. A typical parent roll can have approximately 5,000 to 7,000 layers of wound paper disposed about a core. The end result of having so many layers is the production of pressures near the core of the wound roll that can degrade the desired properties of the paper disposed proximate to the core.

It is also known in the industry that a portion of a physical property of a tissue paper, such as caliper, can be permanently reduced if the pressure is above a known limit for the paper. Thus, the parent roll tends to lose caliper in the wound paper product that is disposed proximate to the core and radially outward several inches hence. The end effect of the resulting compression to the paper is the production of finished product rolls that do not meet desired diameter and/or winding physical property targets. Additionally, such defects in the paper substrate can cause down time in wrapping systems and could ostensibly reduce consumer appeal due to the perceived looseness of the final rolls and resulting packaging.

Several unsuccessful attempts have been made to minimize internal pressures at the core of the wound substrate. Typically, these processes provide for an adjustment of the reel nip loading to provide low pressures upon the web substrate being wound in order to preserve caliper in the finished product. This method can have several adverse effects on the parent roll structure. These adverse effects include having the substrate walk off the core, substrate shifting near the core, and the production of loosely wrapped parent rolls. These resulting parent rolls are known to be difficult to handle and can be severely out of round thereby presenting problems during the converting process.

Other techniques to provide for more uniform core winding can include providing torque at the core of the parent roll while the parent roll is being wound at the reel stage. However, these techniques provide for wrap pressures that can destroy paper properties. Modifications of such systems have been utilized by those of skill in the art; however, these modifications have not been able to eliminate caliper loss near the core of the wound substrate.

Thus, it would be desirable to provide for a coordinated calendering and parent roll winding system that provides for well wound parent rolls and is capable of preserving desired physical properties of the web substrate throughout the entirety of the wound parent roll.

SUMMARY OF THE INVENTION

The instant application invention provides for a process for adjusting a property of a web substrate to form a convolutely wound product. The process comprises the steps of: (a) providing a nip load profile; (b) providing a calender load profile; (c) providing a desired first physical characteristic of the web substrate in at least one location of the web substrate; (d) providing a desired second physical characteristic of the convolutely wound product; (e) winding the web substrate to form the convolutely wound product; (f) measuring an actual first physical characteristic of the web substrate at the at least one location; (g) comparing the actual first physical characteristic and the desired first physical characteristic; (h) adjusting the calender load profile according to the comparison of the actual first physical characteristic and the desired first physical characteristic; (i) measuring an actual second physical characteristic of the convolutely wound product; (j) comparing the actual second physical characteristic and the desired second physical characteristic; and, (k) adjusting the nip load profile according to the comparison of the actual second physical characteristic and the desired second physical characteristic.

DETAILED DESCRIPTION OF THE INVENTION

In order to achieve stable roll structure in a parent roll of wound web substrate, preserve paper characteristics and physical properties and/or parameters, and produce a firm parent roll, a control strategy that coordinates calendering operations and nip loading of a parent roll winding process can achieve the objectives of the present invention. For example, and for the reasons detailed supra, one of skill in the art should readily appreciate that caliper of a wound web substrate can be reduced by 10 to 40 percent for lower density tissue and/or towel web substrates and one to ten percent for other higher density paper, tissue and/or towel substrates and non-woven materials positioned proximate to the core of the parent roll. Accordingly, reduction of the calendering pressure can provide for an increase in the initial caliper at the core of the wound web substrate.

Figure 1:
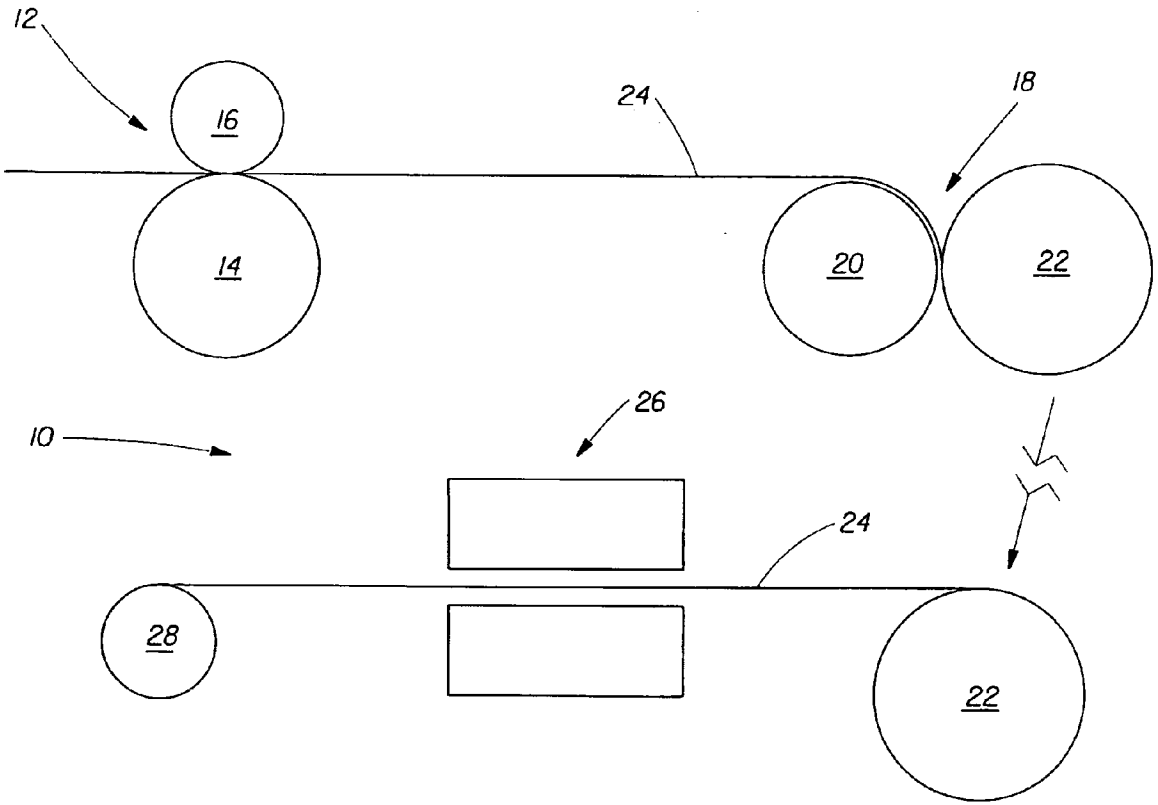
FIG. 1 is a schematic diagram of an exemplary process useful for winding and producing a convolutely wound product in accordance with the present invention; and, FIG. 2 is an exemplary flow chart detailing a preferred embodiment of the process of the present invention.
Figure 2:
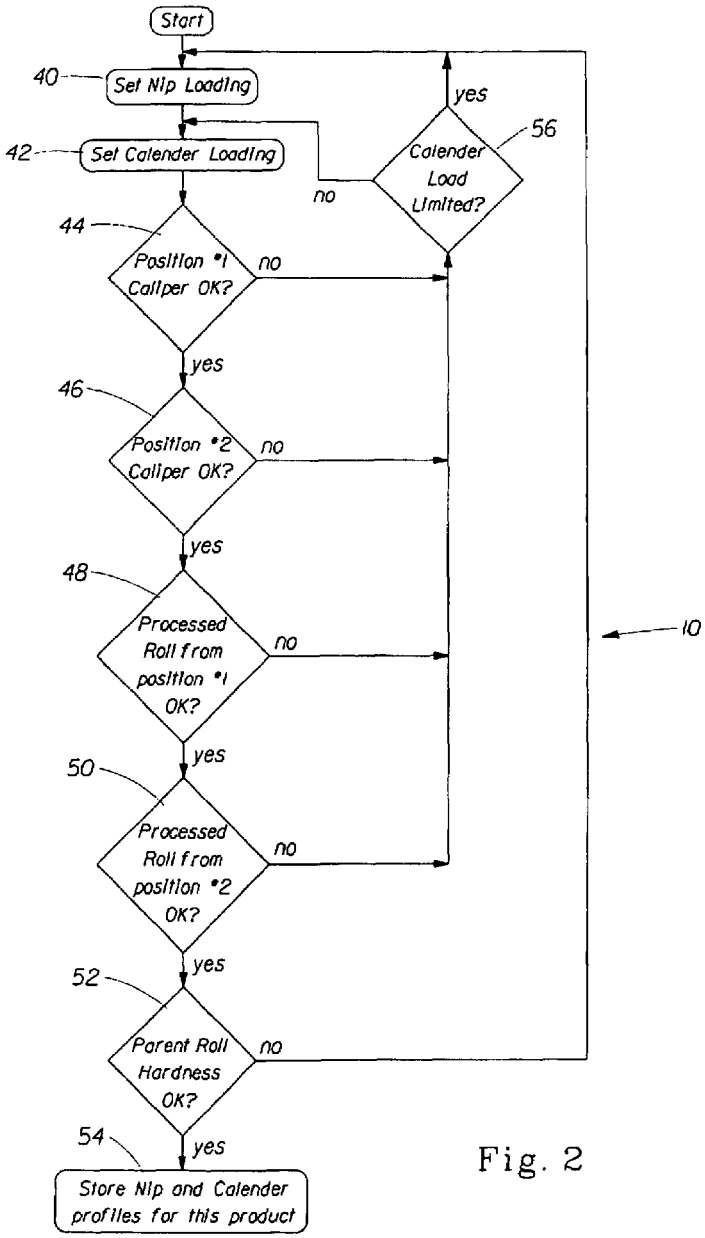

As shown with reference to FIGS. 1 and 2, exemplary process 10 can provide for the maintenance of a desired property (i.e., caliper), or any other physical characteristic desired, in a final product 28 (also referred to herein as 'convolutely wound product') that is subject to various calendering operations. Preferred properties of a final product 28 can include machine direction, cross-machine direction, and z-direction properties of a final product 28, as well as combinations thereof. Exemplary process 10 operates functionally by relieving the calender nip between the first roll 14 and the second roll 16 of a calendering system 12. Exemplary, but non-limiting processes 10 for controlling the force transferred between the first roll 14 and the second roll 16 of a calendering system 12 when opening and closing the calendering nip of calendering system 12 are disclosed in co-pending U.S. patent application Ser. No. 11/451,805 and co-pending U.S. patent application Ser. No. 11/451,817.

In accordance with the present invention, the loading schemes for both calendering system 12 and reel nip system 18 (i.e., calender system 12 loading scheme and reel nip system 18 loading scheme) utilized for the production of parent rolls 22 comprising web substrate 24 are generally each provided with a respective profile relative to the diameter (radius) of the parent roll 22 being wound. By way of example, a conventional reel nip system 18 suitable for use with the present invention and in any typical winding process, can be provided with a reel nip system 18 load profile 40. Such a reel nip system 18 load profile 40 is preferably provided as a nip force as a function of the diameter of the build of parent roll 22 as web substrate 24 is wound thereon. A typical graphical representation of nip force versus diameter is shown in Graph 1.

However, it should be apparent to those of skill in the art that a reel nip system 18 load profile 40 can be provided as a nip displacement as a function of the radius of the build of parent roll 22 as web substrate 24 is wound thereon.

Likewise, the calendering system 12 of a conventional winding process for producing parent roll 22 comprising web substrate 24 can also be provided with a calender system 12 load profile 42. A typical calender system 12 load profile 42 compares the parent roll 22 product roll diameter as web substrate 24 is disposed thereon to the calender nip force provided between the first roll 14 and second roll 16 of the calendering system 12. However, the calender system 12 load profile 42 could also compare the parent roll 22 product roll diameter as web substrate 24 is disposed thereon to the displacement between first roll 14 and second roll 16 of the calendering system 12. A typical calender system 12 load profile 42 is shown in Graph 2.

In accordance with the present invention, at least one desired physical characteristic of the web material 24 forming parent roll 22 is typically provided. However, as will be readily appreciated by one of skill in the art, the desired physical characteristic of web material 24 is preferably measured and compared in at least two desired locations of the web substrate 24 with respect to parent roll 22. Typical physical characteristics of the web substrate 24 can include, but not be limited to: caliper, machine direction stretch, cross-machine direction stretch, compressive modulus, machine direction modulus, cross-machine direction modulus, cross-machine direction width, and the like, and combinations thereof.

The first desired and measured physical characteristic of web material 24 is then coordinated with the second desired and measured physical characteristic of the web material 24 forming parent roll 22. This coordination can then be considered to describe and/or assign some attribute to the structure of the parent roll 22. Typical physical characteristics of the parent roll 22 can include parent roll 22 hardness, parent roll 22 density, in-wound tension, radial pressure, and the like, and combinations thereof.

Following the completion of the parent roll 22, the parent roll 22 can then be processed by a converting operation 26 in which the parent roll 22 is converted into a finished product 28. In some instances, it may be practicable to transport the parent roll 22 to the converting operation 26. This transport may include storage which incurs extra handling of the parent roll 22. The quality of the web substrate 24 comprising the parent roll 22 can have a direct affect on the quality of the finished product 28.

Thus, in order to properly control the parent roll 22 roll structure as the parent roll is being produced, it can be necessary to monitor the quality of the finished product 28. A converting operation 26 suitable for use with the present invention can utilize processes known to those of skill in the art for producing a finished product 28 comprising web substrate 24 from a parent roll 22 comprising web substrate 24. These processes suitable for use with converting operation 26 are usually performed away from the production of parent roll 22 utilizing calendering system 12 and reel nip system 18 winding. Suitable processes associated with converting operation 26 may include, but not be limited to, unwinding, embossing, laminating, gluing, additional calendering, printing, coating, slitting, folding, combining, stacking, winding, and the like, and combinations thereof. In any regard, it is preferred that converting operation 26 be suitable for use for producing a finished product 28 comprising web substrate 24.

It is preferred that the actual physical characteristic of the finished product 28 be related to the physical characteristics that are chosen in order to monitor the quality of the web substrate 24 and the structure of the parent roll 22. Typical physical characteristics of the finished product 28 can include caliper, machine direction stretch, cross-machine direction stretch, in-wound tension, compressive modulus, radial pressure, machine direction modulus, cross-machine direction modulus, cross-machine direction width, sheet length, roll firmness, roll compressibility, roll diameter, converted roll hardness, and combinations thereof. By way of example, a coordination of the physical characteristics could include web substrate 24 machine direction stretch, parent roll 22 in-wound tension, and finished product 28 sheet length. Another exemplary, but non-limiting, set of coordinating parameters could include web substrate 24 caliper, parent roll 22 hardness and finished product 28 roll compressibility.

Once the physical characteristics to be monitored are selected, the process of coordinating the primary adjustments to achieve the target monitored variables can be implemented. The first physical variable associated with the web substrate 24 that forms the parent roll 22 (i.e., caliper, machine direction stretch, cross-machine direction stretch, compressive modulus, machine direction modulus, cross-machine direction modulus, cross-machine direction width, and the like) is measured and/or monitored most frequently and is primarily associated with the first physical characteristic of the finished product 28 (i.e., sheet length, roll firmness, roll compressibility, roll diameter and converted roll hardness). The second physical variable associated with the structure of the parent roll 22 (parent roll 22 hardness, parent roll 22 density, in-wound tension, radial pressure, and the like) is measured and/or monitored less frequently, since it will not likely undergo significant changes and will be preferable, and most likely intentionally, adjusted less often.

The measured first physical characteristic of the web substrate 24 forming parent roll 22 and the desired first physical characteristic web substrate 24 forming parent roll 22 (i.e., caliper, machine direction stretch, cross-machine direction stretch, compressive modulus, machine direction modulus, cross-machine direction modulus, cross-machine direction width, and the like) are then compared. It should be readily realized that comparative data from at least two points throughout the parent roll 22 should be determined. The comparison of the measured first physical characteristic and the desired first physical characteristic of web substrate 24 forming parent roll 22 may be accomplished by manual or processor based algorithms that collect desired data from the appropriate sensors or lab test procedures, or by any other means known to those of skill in the art.

The comparison of the actual first physical characteristic and the desired first physical characteristic of web substrate 24 forming parent roll 22 provides a determined value. This determined value is then used to adjust the calendering system 12 load profile. Adjustments to the calender system 12 load profile can be provided through a calendering system 12 loading algorithm based on the parent roll 22 diameter and target incoming caliper to the calendering system 12. By way of non-limiting example, if caliper is chosen as the first physical characteristic to be monitored, the desired caliper throughout the parent roll 22 should be determined and then compared to the actual caliper measured in at least two different convolutions of the parent roll 22. Measurements taken at the outer convolutions of parent roll 22 can be taken immediately upon completion of the winding of parent roll 22. Measurements at points within the parent roll 22 can be best obtained at the time that portion of parent roll 22 is converted to finished product 28. In any regard to how and where the measurements of the first physical characteristics are made, knowing the difference between the desired caliper and the actual caliper, adjustments to calendering system 12 can be made to eliminate any resulting differential. The amount of adjustment to calender system 12 can depend on the amount of error or difference between the desired caliper and the actual caliper measurement. Computer generated math models of the wound-in pressures and calipers can be useful to make such adjustments to the calender loading profile. It was surprisingly found that these models can predict wound-in caliper from winding variables such as sheet tension, reel nip loading, compressive modulus, machine direction modulus, core drive assist torque values, and the like. One of skill in the art would be readily able to adapt or develop any of the commercially available modeling systems to provide such predictions commensurate in scope with the present invention.

Once a calender system 12 loading change is made to adjust the first physical characteristic, an actual second physical characteristic of the formed parent roll 22 is measured (i.e., parent roll hardness, parent roll density, in-wound tension, radial pressure, parent roll footprint, etc.). One of skill in the art will realize that such measurements can be provided by various off line measurements such as backtender's friend hardness testing, billy club hardness testing, paro roll testing, rhometer hardness testing, Schmidt hammer hardness testing, Smith roll tightness testing, cone force testing (a known modification to the Smith roll tightness testing), acoustic time of flight measurements, axial press testing, caliper in-roll testing, core torque testing, Cameron gap strain testing, as well as a plurality of other techniques for measuring the desired physical characteristic (i.e., such as roll hardness, roll density, etc.) of the parent roll 22. This actual second physical characteristic can then be compared to the desired physical characteristic of the finished parent roll 22 by physical measurement. By way of non-limiting example, if the second physical characteristic chosen is parent roll 22 hardness, several different measurement techniques are suitable for use. Suitable measurement techniques include, cone force tests, time of flight measurements, and parent roll 22 hardness meters.

If the comparison of the second physical variable that describes the roll structure (e.g., parent roll hardness) indicates that an improvement to the reel nip system 18 profile can be made, then the reel nip system 18 load profile is adjusted according to the value determined by the comparison of the actual second physical characteristic and the desired second physical characteristic of web substrate 24 forming parent roll 22. While such adjustments of the reel nip system 18 profile can be made by inference or "rules of thumb" (e.g. parent roll 22 hardness needs to be increased, therefore increase the reel nip 20 pressure.) it will be readily appreciated that it can be helpful to use a computer generated math modeling program of the in-wound pressures, wound-on tensions, and/or wound in caliper of parent roll 22 to provide for efficient reel nip system 18 loading profile adjustments. It was surprisingly found that models can help to limiting overcorrections and destruction of the first physical characteristic (caliper) of web material 24 disposed within parent roll 22 that is desired. Further, one of skill in the art will also readily appreciate that the measurements provided for herein can also be provided at multiple locations on the formed parent roll 22. Thus, an actual second (or more) physical variable(s) and a desired second (or more) physical variable(s) of parent roll 22 can provide a determined value that is then used to adjust and/or further refine the reel nip system 18 load profile.

Finally, the finished product 28 physical property chosen should be monitored and compared to the desired variables to ensure that the final product 28 quality is not affected by the above-mentioned changes. If the finished product 28 physical property(s) changes due to effects of calender system 12 and/or reel nip system 18 loading, appropriate correction should be implemented. By way of non-limiting example, if the finished product 28 property chosen is roll compressibility, then this characteristic should be measured against the desired standard on the web material 24 from at least two locations within the parent roll 22. If the measurement from one location is found to be in error (i.e., not within the desired measure, accuracy, and/or tolerance), the calender system 12 profile should be correspondingly adjusted for the web material 24 being wound at that location within in the parent roll 22. If the measurements from multiple locations within parent roll 22 show significant error, then it may be desirable to adjust and/or change the entire profile. If the calender system 12 loading profile has reached a desired and/or known limit, then the reel nip system 18 loading profile may need to be adjusted since the calendering system 12 loading profile may not be capable of correcting the error.

Without regard to the discussion supra, it should be readily recognized by those of skill in the art that the steps provided can be practiced in any order and still provide for the benefits inured with the present invention. Likewise, it should be easily recognized to those of skill in the art that the described process can be provided as an iterative process allowing for increased flexibility in providing for a stable roll structure in a parent roll 22 of web substrate 24, preserve web substrate 24 characteristics and physical parameters, and produce a firm parent roll 22. That is, that each portion of the overall process described herein can be individually repeated as required by the end user as well as the overall process in order to obtain the objectives, or the desired property, required for the production of a parent roll 22.

The calendering system 12 can be made to operate with the first roll 14 and second roll 16 'not in contact.' This process is known to those of skill in the art as gap calendering. Gap calendering can produce some product changes simply by forcing a thicker web substrate 24 through a narrower "gap." A gap calendering operation may be needed to produce the maximum amount of caliper in the parent roll 22 so that caliper reduction due to higher reel nip system 18 loading will produce the correct final product 28 caliper. In this type of operation, gap to nip to gap, the calendering system 12 controls should be implemented to control the surface speed of both the first roll 14 and second roll 16 in order to minimize shear-induced damage to the web substrate 24. The minimization of such shear-induced damage to the web substrate 24 is disclosed in co-pending U.S. patent application Ser. No. 11/451,805 and co-pending U.S. patent application Ser. No. 11/451,817.

In accordance with the present invention, reel nip system 18 could also be provided as a belt-driven conveyor that is provided in winding contact with the parent roll 22. In such an embodiment of the present invention, the belt-driven conveyor can be driven at a surface speed that corresponds to the speed of the incoming web material 24 being disposed upon parent roll 22. Positioning devices, such as linear actuators, servo-motors, cams, links, and the like known by those of skill in the art as useful for such a result, could be provided to control the position of the belt-driven conveyor relative to parent roll 22. In this way, the position of belt-driven conveyor, when combined with the known diameter growth of the parent roll 22, can provide the required contact, clearance, and/or pressure between the belt-driven conveyor and the parent roll 22 in order to provide for the benefits described supra.

FIG. 2 provides a summary flow-chart of a non-limiting, exemplary process 10 as described in detail above. Once the desired reel nip system 18 loading profile 40 and calendering system 12 loading profile 42 are provided, the comparison of the desired first physical characteristic to the measured first physical characteristic 44 and the comparison of the desired second physical characteristic to the measured second physical characteristic 46 can be provided on an iterative basis. Such iterative corrections are preferably provided as adjustments to the calendering system 12 load profile 42 as discussed supra. If the iterative corrections to the calendering system 12 reach a designed target limit value 56, the reel nip system 18 load profile 40 is preferably adjusted accordingly.

In a preferred embodiment, several iterations of adjustment to the calendering system 12 load profile at a first position of web substrate 24 based upon the desired finished product 28 roll property 48 as well as an adjustment to the calendering system 12 load profile at a second position of web substrate 24 based upon the desired finished product 28 roll property 50 are performed. Finally, a comparison of a desired characteristic of parent roll 22 with the actual characteristic of the parent roll 22 is performed thereby providing adjustments to the reel nip system 18 load profile 40.

As the adjustments to both the calendering system 12 load profile 42 and reel nip system 18 load profile 40 are performed based on the desired processed finished product 28 roll physical property, the calendering system 12 and reel nip system 18 load profiles converge on their final profiles 54 for a particular finished product 28. Typical final profiles 54 and the original profiles for an exemplary finished product 28 are shown in Graphs 3 and 4 below.

In cases where the calendering system 12 must be operated in gap mode for a portion of the parent roll 22 wind, it may be convenient to operate the calendering system 12 loading in units of distance moved. This can require the establishment of a point of initial contact between the first roll 14 and second roll 16 of calendering system 12 in a nipped condition and defining a zero movement position. Positive numbers can then designate one direction (i.e., gap) and negative numbers can designate the opposite direction (i.e., nip). Graph 5 is a typical calendering system 12 loading curve operated with distance units.

Any dimensions and/or numerical values disclosed herein are not to be understood as being strictly limited to the exact dimension and/or numerical value recited. Instead, unless otherwise specified, each such dimension and/or numerical value is intended to mean both the recited dimension and/or numerical value and a functionally equivalent range surrounding that dimension and/or numerical value. For example, a dimension disclosed as "40 mm" is intended to mean "about 40 mm."

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for adjusting a property of a web substrate forming a convolutely wound product, said process comprising the steps of:

(a) providing a nip load profile;

(b) providing a calender load profile;

(c) providing a desired first physical characteristic of said web substrate in at least one location of said web substrate;

(d) providing a desired second physical characteristic of said convolutely wound product;

(e) winding said web substrate to form said convolutely wound product;

(f) measuring an actual first physical characteristic of said web substrate at said at least one location;

(g) comparing said actual first physical characteristic and said desired first physical characteristic;

(h) adjusting said calender load profile according to said comparison of said actual first physical characteristic and said desired first physical characteristic;

(i) measuring an actual second physical characteristic of said convolutely wound product;

(j) comparing said actual second physical characteristic and said desired second physical characteristic; and, (k) adjusting said nip load profile according to said comparison of said actual second physical characteristic and said desired second physical characteristic.

2. The process of claim 1 wherein said adjusted calender load profile is provided as step (b).

3. The process of claim 1 wherein said adjusted nip load profile is provided as step (a).

4. The process of claim 1 further comprising the step of processing said web substrate.

5. The process of claim 4 further comprising the steps of:

(l) providing a desired first characteristic of said processed web substrate;

(m) measuring an actual first characteristic of said processed web substrate at a first location of said processed web substrate;

(n) comparing said actual first characteristic of said processed web substrate with said desired first characteristic of said processed web substrate;

(o) adjusting said calender load profile according to said comparison of said actual first characteristic of said processed web substrate with said desired first characteristic of said processed web substrate.

6. The process of claim 5 wherein said measurement of said actual first characteristic of said processed web substrate is provided in at least a second location of said processed web substrate.

7. The process of claim 5 wherein said adjusted calender load profile is provided as step (b).

8. The process of claim 5 wherein said first characteristic of said processed web substrate is selected from the group consisting of caliper, machine direction stretch, cross-machine direction stretch, in-wound tension, compressive modulus, radial pressure, machine direction modulus, cross-machine direction modulus, cross-machine direction width, sheet length, roll firmness, roll compressibility, roll diameter, converted roll hardness, and combinations thereof.

9. The process of claim 1 further comprising the steps of:

(l) providing a desired second characteristic of said convolutely wound product;

(m) measuring an actual second characteristic of said convolutely wound product;

(n) comparing said actual second characteristic of said convolutely wound product with said desired second characteristic of said convolutely wound product;

(o) adjusting said nip load profile according to said comparison of said actual second characteristic of said convolutely wound product with said desired second characteristic of said convolutely wound product.

10. The process of claim 9 wherein said adjusted nip load profile is provided as step (a).

11. The process of claim 1 wherein said convolutely wound product is selected from the group consisting of paper products, plastics, non-woven materials, foams, foils, films, wire, string, sheet metal, and combinations thereof.

12. The process of claim 1 wherein said calender load profile adjusts the displacement of a first roll in a calender system relative to a second roll in said calender system.

13. The process of claim 1 wherein said nip load profile adjusts the displacement of a first roll in a web substrate winding system relative to said web substrate.

14. The process of claim 1 wherein said calender load profile adjusts the force applied by a first roll in a calender system relative to a second roll in said calender system.

15. The process of claim 1 wherein said nip load profile adjusts the force applied by a first roll in a web substrate winding system relative to said web substrate.

16. The process of claim 1 wherein said property of said web substrate has at least a z-direction component.

17. The process of claim 1 wherein said first physical characteristic of said web substrate is selected from the group consisting of caliper, machine direction stretch, cross-machine direction stretch, compressive modulus, machine direction modulus, cross-machine direction modulus, cross-machine direction width, and combinations thereof.

18. The process of claim 1 wherein said second physical characteristic is selected from the group consisting of parent roll hardness, parent roll density, in-wound tension, radial pressure and combinations thereof.

19. The process of claim 1 wherein said actual first physical characteristic is measured in at least two desired locations.

20. The process of claim 1 wherein said step (f) occurs during said step (e).

* * * * *

UNITED STATES PATENT AND TRADEMARK OFFICE

CERTIFICATE OF CORRECTION

PATENT NO. : 7,484,686 B2
APPLICATION NO. : 11/491414
DATED : February 3, 2009
INVENTOR(S) : Seger et al.

Figure 3:
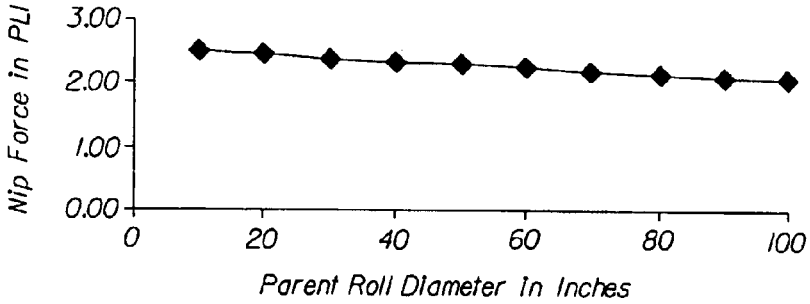
Figure 4:
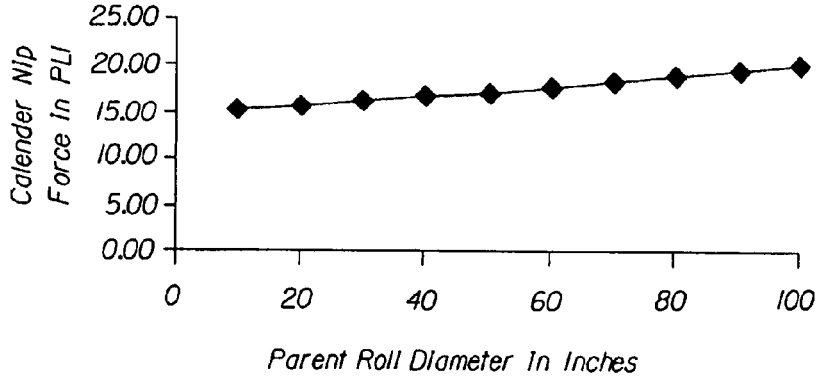
Figure 5:
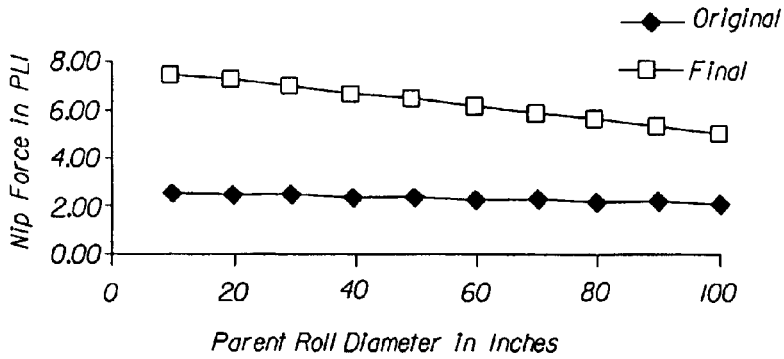
Figure 6:
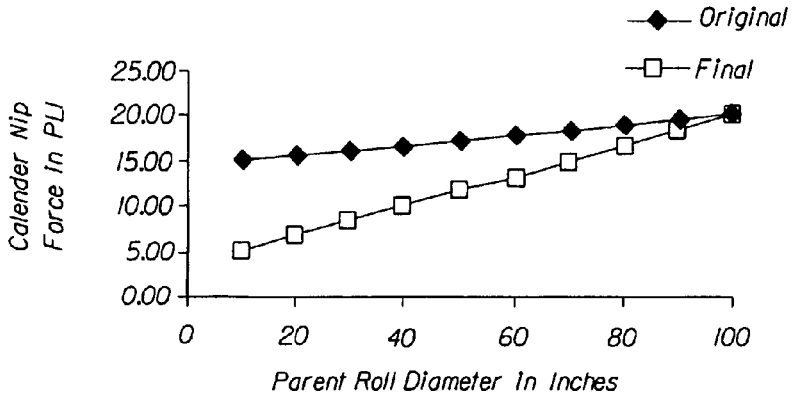
Figure 7:
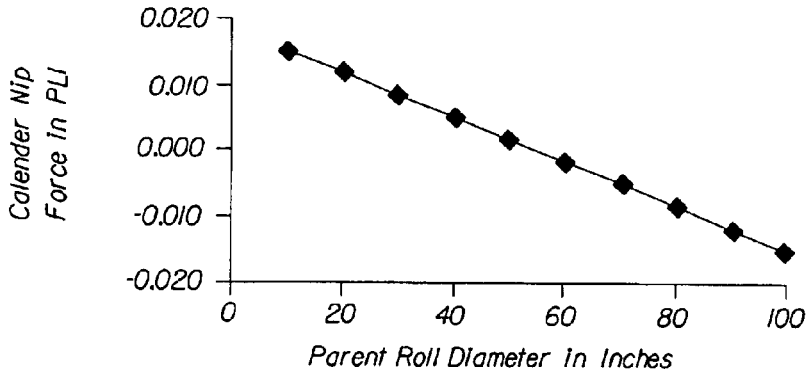

It is certified that error appears in the above-identified patent and that said Letters Patent is hereby corrected as shown below:

In Spec.
At Col. 2, line 28, add the following:

FIG. 3 is an exemplary graphical representation of nip force versus diameter;

FIG. 4 is an exemplary graphical representation of a typical calender system load profile;

FIG. 5 is an exemplary graphical representation of a typical reel nip system final and original load profile;

FIG. 6 is an exemplary graphical representation of a typical calender system final and original load profile; and, FIG. 7 is an exemplary graphical representation of a typical calender system loading curve.

In Col. 3, line 10, delete "Graph 1" and insert therefor --FIG. 3--;

In Col. 3, line 27, delete "Graph 2" and insert therefor --FIG. 4--;

In Col. 7, line 42, delete "Graphs 3 and 3 below" and insert therefor --FIGS. 5 and 6--;

In Col. 7, line 51, delete "Graph 5" and insert therefor --FIG. 7--.

Signed and Sealed this

Fourteenth Day of April, 2009

John Doll

JOHN DOLL
*Acting Director of the United States Patent and Trademark Office*